United States Patent [19]

Raible et al.

[11] 4,006,894

[45] Feb. 8, 1977

[54] SHEET DISTRIBUTING DEVICE

[75] Inventors: Hermann Raible, St. Georgen; Wilfried Dorer, Donaueschingen; Werner Lehmann, Gutach, all of Germany

[73] Assignee: Mathias Bauerle GmbH, Firma, St. Georgen, Germany

[22] Filed: Mar. 3, 1975

[21] Appl. No.: 554,821

[30] Foreign Application Priority Data

Mar. 22, 1974 Germany ..... 2413908

[52] U.S. Cl. ..... 271/173

[51] Int. Cl.[2] ..... B65H 29/58

[58] Field of Search ..... 271/173, 64; 270/58

[56] References Cited

UNITED STATES PATENTS

| | | | |
|---|---|---|---|
| 3,414,254 | 12/1968 | Snellman et al. | 271/173 |
| 3,430,951 | 3/1969 | Hulka et al. | 271/64 |
| 3,685,819 | 8/1972 | Deutsch | 271/173 |
| 3,717,249 | 2/1973 | Faley | 271/64 X |
| 3,744,790 | 7/1973 | Hoffman | 271/173 |

*Primary Examiner*—Evon C. Blunk
*Assistant Examiner*—Bruce H. Stoner, Jr.
*Attorney, Agent, or Firm*—Finnegan, Henderson, Farabow & Garrett

[57] ABSTRACT

A sheet distributing device includes a plurality of sheet receiving pockets for receiving sheets in a predetermined sequence. A flexible belt conveyor is provided for transporting sheets in a transport plane adjacent in-feed openings of the pockets. A pair of guide rolls is positioned at the in-feed opening of each of the pockets and each pair of rolls is positioned tangent to a lower run of the belt conveyor and extends transverse to the transport plane in spaced apart parallel relation. A deflector means is movable on a path parallel to the transport plane and also between a raised position and a lowered position against the lower run of the belt conveyor. In the lowered position the deflector means locally deforms the belt conveyor into a loop between a pair of the guide rolls to thereby divert a sheet from the transport plane and direct it into a pocket.

20 Claims, 5 Drawing Figures

SHEET DISTRIBUTING DEVICE

BACKGROUND OF THE INVENTION

In known sheet distributing devices there is provided a pair of horizontally spaced guide rolls rotatably supported in a movable carriage associated with a deflector means. Positioned between the guide rolls is a sheet gate adapted to swing about an axis lying in a sheet transport plane. The deflector means comprises a flat deflecting plate movable between two fixed positions. In one position the gate deflects an approaching sheet from the sheet transport plane into a collection pocket arranged below the plane, while in the other position the deflector means forms a bridge between the guide rolls such that the approaching sheet in the sheet transport plane may be conveyed in a straight line path and exit from the apparatus at an outlet end of the machine.

The carriage is continuously movable in the direction of sheet transport and is driven intermittently from one collection pocket to another, and in its return travel in the opposite direction it is driven from the last collection pocket to the first pocket. The guide rolls of the carriage support an endless belt adapted for movement into different planes, i.e., by means of rollers positioned in a rectangular array the belt is caused to travel in a rectangular sheet transport path around the pockets defining a collection compartment. The sheets entering or passing through the sheet transport plane lie unattached on the belt sections passing through the sheet transport plane. The carriage is further provided with pressure rolls, positioned above and in contact with the guide rolls, for applying the required thrust speed to the individual sheets to be deflected into the pockets.

The step-wise movement of the carriage from one pocket to the next is controlled by means of the belt drive incorporating an electromagnetically actuable arresting device for blocking one of the guide rolls. There is further provided an electrically controlled mechanical stop device for controlling the intermittent movement of the carriage. Because of various circumstances, and particularly because of the reduced velocity of the intermittent driving of the carriage and the sheet conveyance in the zone of the deflector means, the work speed which can be attained with this apparatus is substantially limited.

In still another known device for distributing sheets in a predetermined sequence there is shown a track means providing a horizontal sheet transport plane. At one end of the plane there is provided a pair of conveyor belts arranged one above the other and in contact with each other. Also provided is a diverting gate in the form of a rotatable double-wedge adapted to be set at any one of three different positions. Positioned beneath the gate is a belt set, driven in a vertical direction and guided by a carriage which is movable intermittently in a vertical plane adjacent entrance openings of collection pockets arranged one above the other in a stack.

The vertically driven belt sets comprise a set of belts guided by support rolls arranged in a stationary frame and by vertically positioned deflector rolls which effect a horizontal diversion of the sheet. The other group of belts of the belt set are supported on the upper rolls of the carriage by stationary deflector rolls positioned above the conveyor line of the carriage and by a movable tension roll positioned in the sheet transport plane of the deflector rolls. The tension roll is fastened to a drive cable associated with a chain drive of the carriage. While this apparatus provides a somewhat faster work speed than the apparatus described, supra, because of the use of four different conveyor belt sets of which two sets form a sheet transport plane and the other two sets form a sheet feed path perpendicular thereto, the apparatus is fairly complex requiring a substantial number of expensive components.

Both of these devices provide arrangements whereby the sheets may be fed into the transport plane from either end of the machine to permit several machines to be arranged in tandem so that any desired number of different sheets may be distributed into a number of collection pockets.

In still another known sheet distribution device, which can also be arranged in tandem, there is provided a vertical stack of sheet receiving pockets. The sheets are transported in a path above the pockets and, by means of vertically arranged conveyor rolls positioned side-by-side in pairs and a vertical belt drive roller means, the sheets are transported in a vertical feed path. A separate gate means is associated with each of the pockets for diverting a sheet into a respective receiving pocket.

All of these prior devices represent fairly complex and expensive sheet distributing apparatus. Additionally, however, because these devices utilize a substantial number of components and controls for driving and operating the various mechanisms, they are subject to more frequent servicing and adjustment and do not lend themselves to high speed and completely reliable operation.

SUMMARY OF THE INVENTION

The present invention provides a sheet distributing or sorter device including an improved sheet transport and a sheet deflector means of simple construction adapted for rapid operation to thereby provide a high speed sheet distributing device which is reliable in operation and relatively inexpensive to manufacture.

The present invention comprises an arrangement wherein at least one endless belt conveyor is supported and driven such that a lower run of the belt and a series of guide rolls form a sheet transport plane therebetween. A sheet is diverted from the transport plane by a sheet deflector means comprising at least one deflector roll movable between a raised position and a lowered position between a pair of guide rolls to deform the belt into a U-shaped loop for delivering the sheet to a receiving pocket.

This arrangement provides positive and reliable transport of a sheet through the transport plane, and ejection and delivery of the sheet into a pocket by the deflector means, thereby increasing the work speed that can be attained. It also simplifies the construction and reduces the cost since it is possible to utilize a single endless belt or a single guide roll pair to provide a common sheet drive and transport plane.

The raising and lowering motion of the deflector means does not require elaborate control means because the motion is imparted thereto in response to rotational movement of the deflector means. Thus, the operation of the deflector means is comparable to the action obtained by engagement of a gear wheel with a gear rack, the deflector roll corresponding to the teeth of the gear wheel and the pairs of guide rolls corresponding to the teeth of the gear rack. In addition to eliminating the need for control means for raising and lowering the deflector rolls, the control of the step-wise movement of the deflector means is simplified because it is not necessary to synchronize or maintain an exact distance of intermittent movement of the deflector means thereby permitting substantial tolerances without effecting reliable operation. Because of the stationary positions of the guide rolls and the sheet receiving pockets, the operation is not adversely effected if the axis of the deflector means is arrested directly above the axis of the lowermost deflector roll, or slightly ahead of or behind the axis. Thus, in each case the entrance position and direction of the deflector roll into a gap or space between a pair of guide rolls is positively maintained by the pair of guide rolls associated with a particular sheet receiving pocket.

Preferably, a shaft mounting the deflector means is associated with a pair of drive belts which may be driven in opposite directions. This avoids the need for costly devices for reversing the direction of movement of the deflector means and, also, contributes to reliable and increased work speed operation.

One arrangement for driving the belts is to support the belts on drive and support rolls wherein one of the drive rolls is coupled with a pair of meshing gear wheels and an electromagnetic device, and the other drive roll is coupled with a continuously driven conversion shaft through a gear belt and a second electromagnetic coupling. This arrangement provides positive and accurate sheet control and allows attainment of the desired velocity of the deflector means both in a step-wise movement and a continuous return drive. It is to be noted, however, that the deflector means may be driven in a step-wise manner in both directions.

An electromagnetically operable brake device is provided for arresting the deflector means at each of its operating positions for diverting a sheet into a pocket, and provides a means for uniformily and accurately maintaining the distance of step-wise movement of the deflector means. Another advantage of the use of the brake and electromagnetic couplings is that, unlike the use of solely mechanical components, they provide for a substantially noiseless operation.

Another feature of the invention is that the conversion shaft is operatively associated by gear belts with a drive motor, while the gear belt for driving the endless belt conveyor is provided with a variable speed drive means. This provides for independent drive of the deflector means and the endless belt conveyor by a single motor, and also allows for driving the deflector means at a constant velocity and the endless belt conveyor at variable selective velocities.

To provide for tandem operation of the device it is necessary to be able to inactivate the deflector means. For this purpose the device includes a sheet-turning trough positioned adjacent each end of the sheet transport plane to divert a sheet back into the transport plane for further conveyance and exiting to the next apparatus arranged in tandem. While the sheet deflector means could be inactivated by raising it up and out of its normal operating plane, the present invention provides for maintaining the deflector means in its normal plane of operation and movement, in a ready position when again activated. Thus, the requirement for additional controls is avoided and the reliability of operation is increased.

The drive shaft for driving the endless belt conveyor is also provided with a pair of pivotal levers supporting an adjustable tensioning roll. The tensioning roll coacts with a section of the endless belt conveyor between the deflector means and the drive shaft to compensate for the excessive length of the endless belt conveyor required for forming the U-shaped loops for diverting a sheet into a pocket. Although other forms of tensioning means might be utilized, in practice it has been found that, because of the relatively high rate of speed of the endless belt conveyor there is a considerable reduction of belt tension in the stretch between the deflector roll and the drive shaft which could result in improper conveyance of a sheet through the transport plane. This is avoided by the present arrangement by providing a tensioning means for applying a uniform degree of tension along the entire sheet transport plane, in a direction transverse thereto, regardless of the direction in which the endless belt conveyor is being driven.

It is an object of the present invention to provide a sheet distributing device comprising at least one flexible endless belt conveyor means having its lower run in contact engagement with a plurality of guide rolls arranged in pairs. A deflector means is intermittently driven on a path parallel to the endless belt means and is adapted to deflect a sheet from the transport plane and, also, to be moved between a raised position and a lowered position against the lower run of the belt. In the lowered position the deflector means locally deforms the belt means into a U-shaped loop between a pair of guide rolls by partially wrapping the belt means around the guide rolls and the deflector means to thereby change the direction of the sheet from the transport plane into a pocket.

Another object of the invention is to provide a deflector means having a plurality of projecting arms, each supporting a deflector roll, positioned at equal radial distances corresponding to the distances between pairs of guide rolls such that as the deflector means is moved on the path it is also rotated so as to present one of the deflector rolls thereof into an operative position to form a U-shaped loop in the endless belt between a pair of the guide rolls to thereby divert a sheet from the transport plane and direct it into a pocket.

Another object of the invention is to provide sheet turning means in the form of a trough to redirect a sheet back into the sheet transport plane for delivery to another sheet distributing device arranged in tandem.

Another object is to provide means for controlling movement of the deflector means step-wise from pocket to pocket, or continuously, in opposite directions on the path.

Other objects, features and advantages will appear hereinafter as the description proceeds.

IN THE DRAWING

DESCRIPTION OF THE PREFERRED EMBODIMENT

Figure 2:
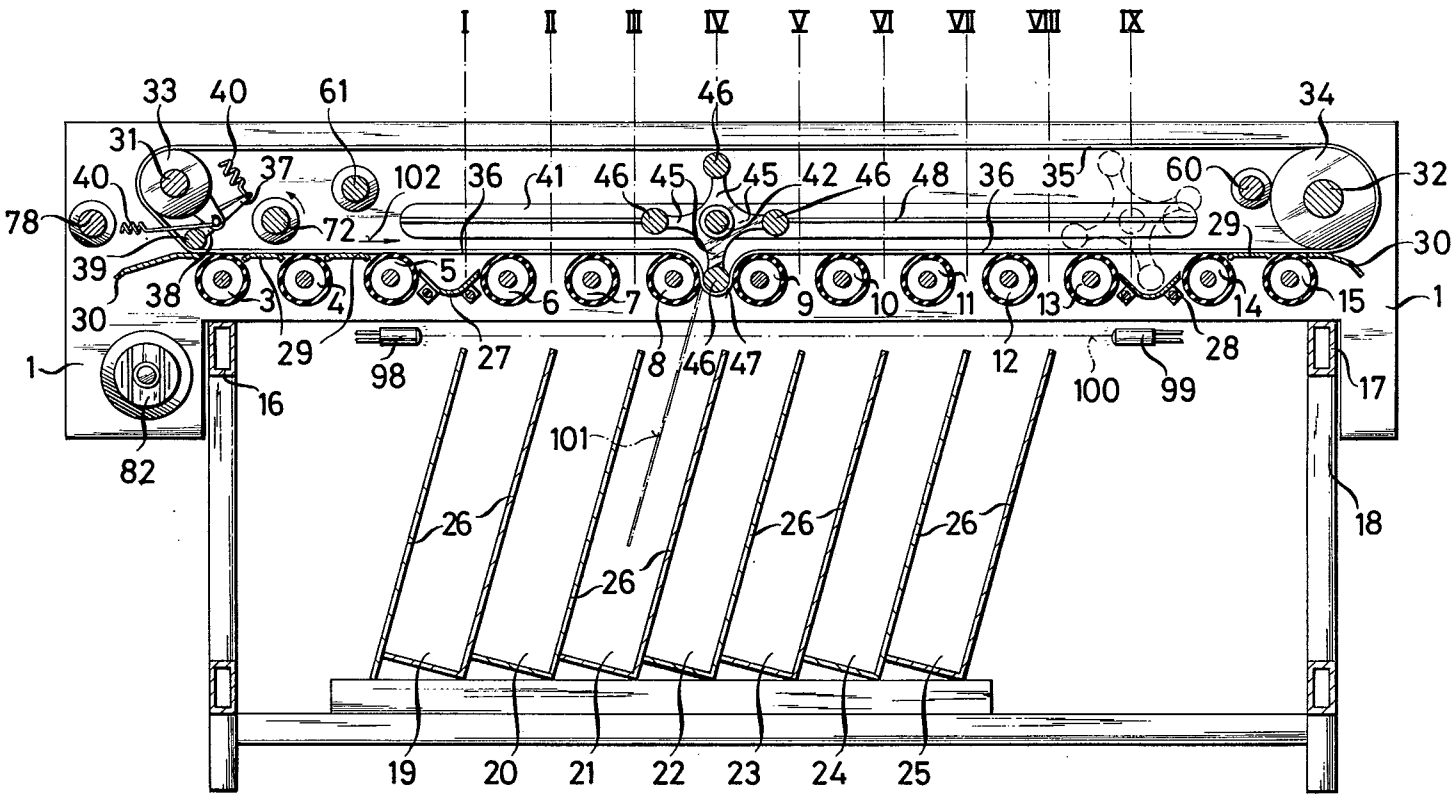
FIG. 2 is a section taken substantially in the plane of the line II—II of FIG. 1.

As shown in FIG. 2, there is provided a frame comprising a pair of vertical support members 18 each provided with a transverse support bar 16 and 17 for mounting thereon a pair of side plates 1 and 2. A plurality of guide rolls 3 – 15 are rotatably mounted in a plane between the side plates 1 and 2. Although the guide rolls are shown as being positioned in a horizontal plane, it is to be understood that they may be arranged in a vertical plane to thereby provide a vertical as opposed to horizontal sheet distributing apparatus. Positioned beneath the guide rolls are a plurality of sheet receiving pockets 19 – 25 arranged in seriatim and having their sheet in-feed openings adjacent the guide rolls. Although the pockets 19 – 25 are represented merely in simplified form in FIG. 2, it is only necessary that each pocket be associated with a corresponding pair of guide rolls 6 – 13 and that the distance between each pair of the guide rolls 6 – 13 corresponds to the distance between respective side walls 26 of the associated pocket.

While the outer groups of the guide rolls 3, 4, 5 and 14, 15 serve merely to extend the sheet transport plane comprising the guide rolls 3 – 15, the centrally positioned guide rolls 6 – 13 have an additional function as will be explained hereinafter. With reference to FIG. 2, it will be observed that the distance between each pair of guide rolls 5, 6 and 13, 14 is greater than the distance between each of the individual pairs of guide rolls 6 – 13. Positioned between the guide rolls 5, 6 and 13, 14 is a trough-like sheet turning device 27 and 28 respectively, extending parallel with the axes of the guide rolls and secured to the side plates 1 and 2. These turning devices 27 and 28 provide for redirecting a sheet back into the sheet transport plane in those instances where the sheet is to be exited from the apparatus, or where more than one sheet distributing apparatus is arranged in tandem.

At one end of the sheet transport plane there is provided a pair of guide plates 29 spanning the gap between the guide rolls 3, 4 and 4, 5 and at the other end of the transport plane there is provided a similar guide plate 29 spanning the distance between the guide rolls 14 and 15. A further guide plate 30 is provided at the entrance end of the sheet transport plane adjacent the guide rolls 3, and at the exit end of the transport plane there is provided a similar guide plate 30 adjacent the guide roll 15. At each end of the sheet transport plane, which extends from the guide roll 3 to the guide roll 15, there is provided a drive shaft 31 and a shaft 32 respectively, rotatably supported between the side plates 1 and 2. The drive shaft 31 is provided with a plurality of drive rolls 33 and the shaft 32 is provided with a plurality of idler rolls 34. The drive rolls 33 are fixed on the drive shaft 31 while the idler rolls 34 are rotatably supported on the shaft 32. Each of the corresponding pairs of drive rolls 33 and idler rolls 34 support thereon a flexible endless belt conveyor means 35 having a lower run 36 tangent with the peripheries of the guide rolls 3 – 15. The lower runs 36 of the endless belt means 35 and the guide rolls 3 – 15 define the sheet transport plane for capturing a sheet therebetween and conveying the sheet therethrough.

With further reference to FIG. 2 it will be seen that the diameters of the drive rolls 33 are smaller than the diameters of the idler rolls 34 to thereby accommodate a belt tensioning roll 39 adjacent the drive rolls 33. The tensioning roll 39 is associated with swingable levers 37 and 38 (see also FIG. 1) and is movable circumferentially and radially in relation to the drive rolls 33. A spring 40 is connected to each of the levers 37 and 38 to bias the tensioning rolls 39 in a clockwise direction, as viewed in FIG. 2, and to maintain the endless belt means 35 taut, particularly the lower runs 36 of the belt means.

Figure 3:
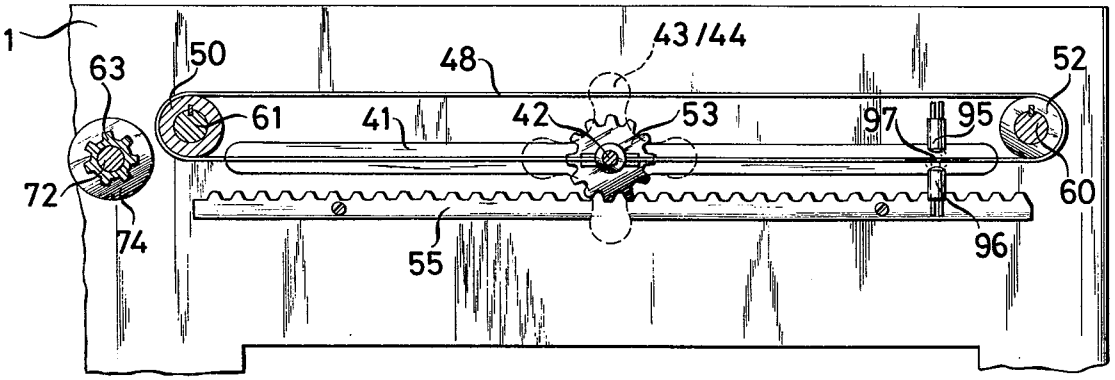
FIG. 3 is a section taken substantially in the plane of the line III—III of FIG. 1 illustrating a sheet deflector means and control means therefor.
Figure 5:
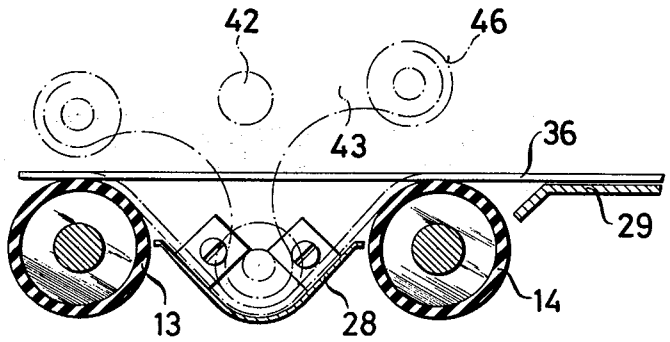
FIG. 5 is a section taken substantially in the plane of the line V—V of FIG. 1 showing a sheet turning device for redirecting a sheet back into the transport plane.

Still referring to FIG. 2, each of the side plates 1 and 2 is provided with a slide guide 41 extending parallel to the sheet transport plane and spaced thereabove. A shaft 42 is rotatably supported in the slide guides 41 such that its axis extends parallel with the axes of the guide rolls 3 – 15 and transverse to the direction of sheet transport. The shaft 42 is movable on a horizontal path in the slide guides 41. A carriage mounted sheet deflector means in the form of turnstiles 43 and 44, FIGS. 2, 3 and 5, is rotatably supported on the shaft 42. Each of the turnstiles 43 and 44 is provided with a plurality of radially projecting arms 45 of equal length and spaced at equal radial distances from each other. Provided at the free end of each of the arms 45 is a rotatable deflector roll 46 mounted between corresponding arms 45 of the turnstiles 43 and 44, and transversely spanning the endless belt means 35. The length of each of the arms 45 of the turnstiles 43 and 44, as well as the angular distance between each of the arms 45, is such that the distance between adjacent deflector rolls 46 corresponds approximately to the axial distance between each of the pairs of guide rolls 6 – 13. Thus, when the shaft 42 of the carriage mounted deflector means is positioned above the space or gap between a pair of guide rolls 6 – 13, the lowermost one of the deflector rolls 46 locally deforms all of the conveyor belts 35 so as to form a U-shaped loop between a pair of guide rolls such that the deflector roll 46 and the guide roll pair form a loop 47 for deflecting and delivering a sheet into a sheet receiving pocket 19 – 25 as shown in FIG. 2.

With reference to FIGS. 2 and 3, each end of the shaft 42 is provided with a drive belt 48 and 49 positioned on the outside of the side plates 1 and 2 respectively. The belt 48 is supported on a drive roll 50 and an idler roll 52, and the belt 49 is supported on a drive roll 51 and an idler roller 52′. The shaft 42 is further provided with gear wheels 53 and 54 in meshing engagement with gear racks 55 and 56 respectively. The gear racks 55 and 56 are fastened to the outer surfaces of the side plates 1 and 2 respectively, and extend in the direction of sheet feed, indicated by an arrow 102, substantially the length of the slide guides 41. One end of the shaft 42 is also provided with a disc 57 for actuating a pair of switches 58 and 59, positioned at opposite ends of the path of travel of the turnstiles 43 and 44, which serve to signal the position of the deflector means at its terminal end positions on the path.

The idler rolls 52 and 52′ for the belts 48 and 49 respectively, are mounted on a shaft 60 rotatably supported between the side plates 1 and 2. The drive roll 50 is freely supported on the shaft 61 and is secured to a gear 62 in meshing engagement with a pinion 63. The drive roll 51 is nonrotatably supported on the shaft 61 and is associated with a gear belt pulley 64 drivingly associated, by a gear belt 65, with a second gear belt pulley 66. The end of the shaft 61 supporting the drive roll 51 and the gear belt pulley 64 is further provided with a rotatable element 67 of an electromagnetic coupling 68 which serves as a brake for arresting movement of the turnstiles 43 and 44. The brake is mounted against rotation on an auxiliary side plate 69 secured to the side plate 2 by means of members 70 and 71.

The gear belt pulley 66 and the pinion 63 are freely mounted on a common transmission shaft 72 with which they can be drivingly coupled independently by electromagnetic couplings 73 and 74 respectively. On the end of the transmission shaft 72 supporting the pinion 63 and the electromagnetic coupling 74 there is provided a non-rotatable gear belt pulley 75 drivingly connected with a gear belt pulley 77 by a gear belt 76. The gear belt pulley 77 is non-rotatably mounted on a shaft 78 rotatably supported between the side plates 1 and 2 and the pulley 77 is driven through a gear belt drive comprising a pair of gear belt pulleys 79 and 81 and a gear belt 80. The power for driving the belts and the pulleys is provided by a motor 82.

Positioned at the outside of the side plate 2 and supported on the shaft 78 there is provided a variable speed drive means 83 comprising a V-belt pulley having a fixed portion 84', and a movable portion 84 which can be slid or pushed axially along the shaft 78 but is fixed against rotation thereon. The axial sliding movement of the pulley is effected against the biasing action of a spring 85 supported on a bushing 86 associated with the shaft 78. This two part V-belt pulley is drivingly associated by a V-belt 87 with a pulley 88 mounted on the drive shaft 31.

Figure 4:
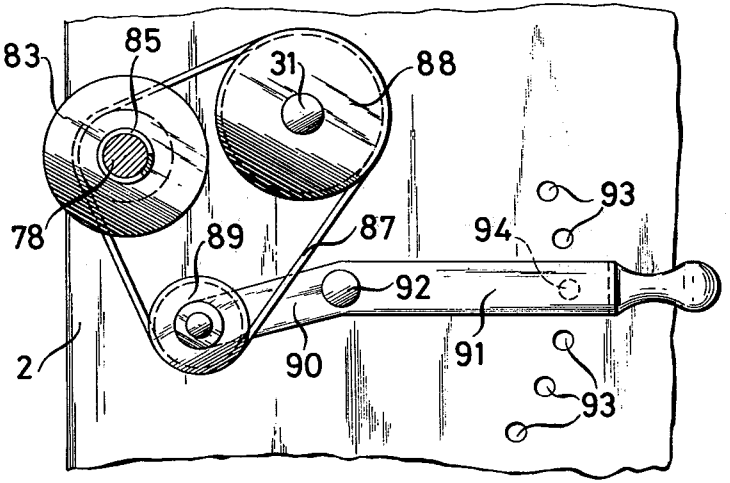
FIG. 4 is a section taken substantially in the plane of the line IV—IV of FIG. 1 showing a means for tensioning the endless belt conveyor.

With reference to FIG. 4, which illustrates the variable speed drive means 83, it will be seen that the V-belt 87 is trained around a tension roll 89 rotatably supported on an arm 90 of a lever 91. The lever 91 is pivotally supported on a pivot bearing 92 provided in the side plate 2, and the lever 91 may be positioned and retained at any one of a number of selected positions by positioning a peg 94 of the lever 91 into a selected hole 93 in the side plate 2. Thus, by moving the lever 91 to a selected position, the effective conversion ratio between the V-belt pulley of the variable speed drive means 83 and the V-belt pulley 88 can be varied without influencing the conversion ratio produced between the motor 82 and the transmission shaft 72.

Figure 1:
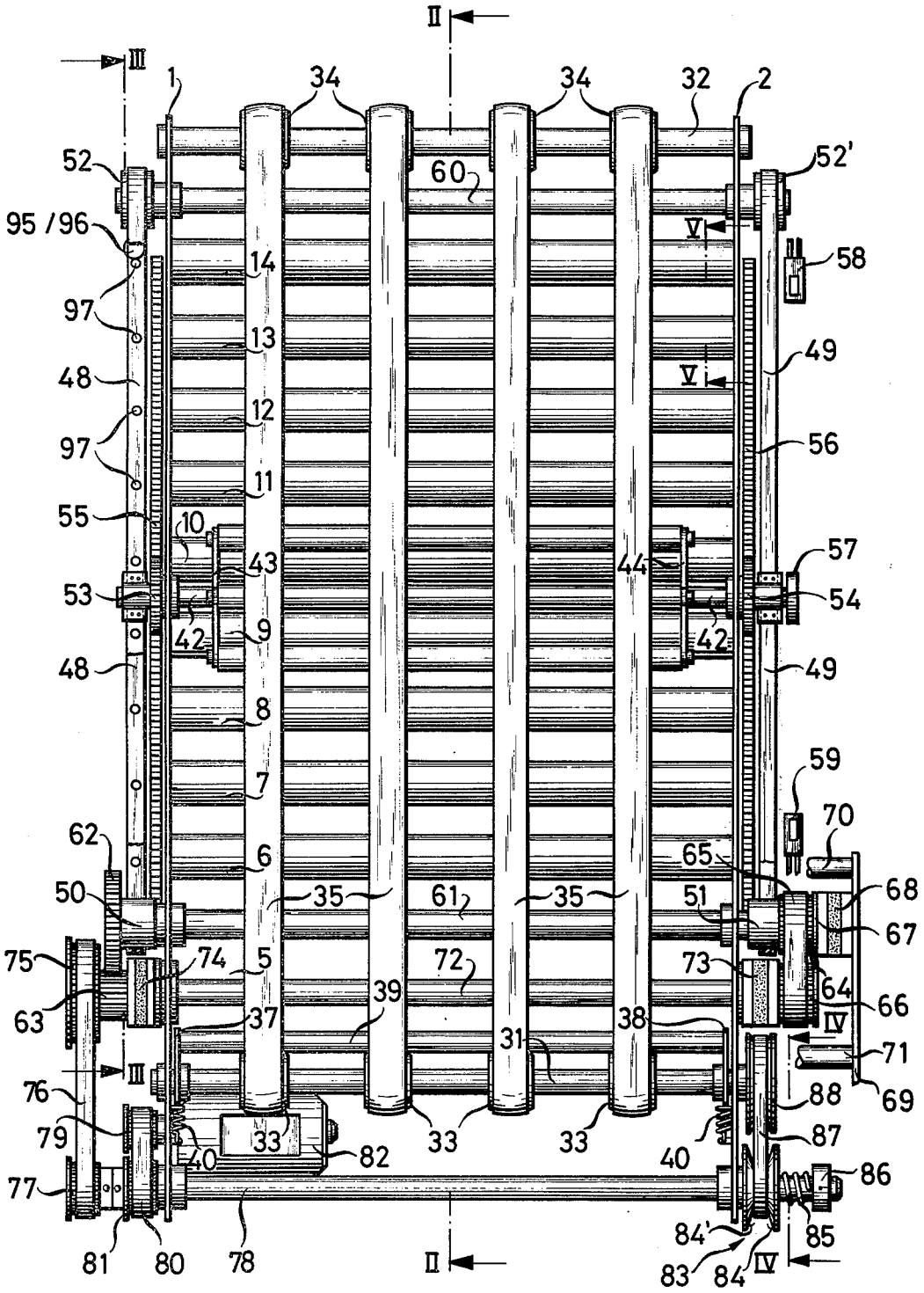
FIG. 1 is a plan view of a sheet distributing apparatus for distributing sheets into a plurality of pockets in a predetermined sequence in accordance with the present invention.

With reference to FIG. 1, the electromagnetic couplings 73 and 74 and the brake coupling 68 are controlled by providing, adjacent the idler roll 52 of the drive belt 48, a first control means including a light housing comprising a light source 95 and a photoelectric element 96 arranged on a common axis which intersects a lower run of the drive belt 48. The drive belt 48 is provided with a series of holes 97, or other suitable code markings such as transparent areas, which are scanned by the photoelectric element 96 to thereby produce a stop signal for arresting movement of the shaft 42 and the turnstiles 43 and 44 whenever the shaft 42 is moved step-wise a distance from one pocket to an adjacent pocket of the pockets 19 – 25.

To initiate driving of the shaft 42 after it has been arrested, there is provided a second control means including a light housing (FIG. 2) positioned under the guide rolls 6 – 13 comprising a light source 98 and a photoelectric element 99. The light source 98 and the photoelectric element 99 are arranged on a common horizontal axis 100 which is intersected by a sheet 101 being delivered into one of the pockets 19 – 25.

A description will now be given of the overall operation of the sheet distributing device of the present invention.

In response to energization of the motor 82, the drive shaft 31 and the transmission shaft 72 are driven continuously. While the number of rotations of the transmission shaft 72 remains constant with the RPM of the motor 82, the RPM of the drive shaft 31 may be varied by the variable speed drive means 83, as desired or required. Although only the direction of drive of the belts 48 and 49 is described as being reversible, the direction of drive of the belt conveyor 35 may also be reversed by utilizing a reversible motor 82.

The various positions assumed by the shaft 42 are indicated in FIG. 2 by the Roman numerals I – IX. Assuming that the device is arranged for feeding sheets from the left as viewed in FIG. 2, with the sheets 101 to be distributed into the pockets 19 – 25, the drive shaft 31 is rotated in a counterclockwise direction such that the lower run 36 of each of the endless belts 35 is driven in the direction of the arrow 102. At the start of the operation, the shaft 42 is in the position II and one of the deflector rolls 46 of the turnstiles 43 and 44 is directly below the shaft 42 and positioned between the pair of guide rolls 6 and 7 to thereby locally deform the lower runs 36 of each of the endless belts 35 into a U-shaped loop to deflect the sheet into the pocket 19. Although this description refers to the shaft 42 being in the position II, the actual mechanism and related positions described are illustrated in the position IV, as shown in FIG. 2.

As the sheet 101 being delivered into the pocket 19 intersects the axis 100 of the light housing 98, 99, a control means (not shown) is actuated and, in turn, actuates the second control means which activates the electromagnetic coupling 74 and drivingly meshes the pinion 63 on the transmission shaft 72 with the gear wheel 62. This action rotates the drive roll 50 which imparts driving motion to the belt 48 and moves the shaft 42 on the path from the position II to the position III. In response to arrival of the shaft at the position III, the light housing 95, 96 scanning the holes 97 in the belt 48 produces a signal which actuates the first control means for de-energizing the electromagnetic coupling 74 and, simultaneously therewith, energizing the electromagnetic brake coupling 68 which is effective to arrest rotation of the shaft 61 supporting the drive rolls 50 and 51 and, also, to arrest movement of the shaft 42 supporting the turnstiles 43 and 44. It will be appreciated that this step-wise movement of the shaft 42 from the position II to the position III results in the U-shaped loops which were formed at the position II to be returned into the straight sections of each of the lower runs 36 of the belt conveyor 35 and the formation of new loops 47 at the position III. This is accomplished by the horizontal movement of the shaft 42 and the rotational movement of the turnstiles 43 and 44 lowering the next deflector roll 46 into the space between the pair of guide rolls 7 and 8.

When the shaft 42 arrives at the position III, the next sheet 101 is diverted from the sheet transport plane into the pocket 20 by the deflector roll 46 coacting with the belts 35 and the guide rolls 7 and 8. In response to activation of the second control means by the signals produced by the light sources 95, 96 and photocells 98, 99 respectively, the movement of the deflector means is continued until the shaft 42 arrives at the position VIII. In the position VIII, the switch 58 is activated by the disc 57 on the shaft 42 to thereby provide a signal which may be stored in a suitable storage means, or it may be utilized immediately to energize the electromagnetic coupling 73 on the transmission shaft 72. In the latter case, there are two possible modes of operation, namely, the shaft 42 may be returned in a step-wise manner from the position VIII through the various positions until it arrives at the position II, thereby continuing to direct sheets 101 into individual pockets 19 – 25 during its return travel to the position II. In the other mode of operation the shaft 42 may be returned in a continuous manner, rather than step-wise, from the position VIII to the position II in readiness for a subsequent sheet distributing operation. The mode of operation desired is dependent upon the control means utilized and the particular requirements of the application.

In those instances wherein a second sheet distributing apparatus is to be arranged in tandem, the turnstiles 43 and 44 are arranged to move from the position VIII to the position IX whereat they are arrested. In this position the turnstiles 43 and 44 and the deflector roll 46 are in a position represented in dotted outlines in FIGS. 2 and 5, wherein the lowermost deflector roll 46 coacts with the trough 28 to redirect an approaching sheet 101 from the trough 28 back into the sheet transport plane so that it may be conveyed to the next sheet distributing device arranged in tandem.

The sheet turning or trough device 27 positioned between the guide rolls 5 and 6 has the same function as the trough 28 and is utilized when the sheets are fed in the opposite direction. A switch 49 is provided for this purpose and is activated in response to the turnstiles 43 and 44 arriving at the position II.

In the event that it is desired to drive the endless belt conveyor 35 alternately in opposite directions, it is preferred to arrange the sheet receiving pockets 19 – 25 to be movable an amount approximately equal to the diameter of the deflector roll 46. This is desirable in order to maintain alignment of the pockets with the sheet 101 which, when transported in the opposite direction, is diverted into the pocket by the deflector roll 46 and the guide roll positioned immediately to the right side of the deflector roll 46, rather than the left side, as viewed in FIG. 2.

To provide for positive sheet reception by the pockets and high speed operation, it is preferable to maintain the distance between the in-feed openings of the pockets 19 – 25 and the guide rolls 6 – 13 at a minimum. This may be attained by providing height-adjustable bottoms to the pockets 19 – 25 thereby minimizing the distance of free fall of the individual sheets 101 into the pockets. While the device described and illustrated herein provides only seven pockets 19 – 25 and associated pairs of guide rolls 6 – 13, it will be appreciated that the sheet distributing device may incorporate any number of sheet receiving pockets and corresponding pairs of guide rolls.

As shown in FIG. 2, it is desirable to arrange the turnstiles 43 and 44 such that the deflector roll 46 extends a maximum distance downwardly between corresponding pairs of guide rolls 6 – 13 such that the axis of the deflector roll 46 lies in a plane approximately at or below the plane of the axes of the guide rolls. This arrangement provides a maximum time duration to the deflector means for positively diverting and delivering the sheet into a pocket and also contributes to increasing the work speed.

The electromagnetic brake coupling 68, for arresting the shaft 61 and thus stopping movement of the shaft 42 and the turnstiles 43 and 44 in any one of the positions I – IX, remains energized at each of the shaft positions I – IX and it is de-energized in response to the initial step-wise movement of the shaft 42 towards the next position. The control means for controlling the electromagnetic couplings 68, 73 and 74 may also be arranged with a counting device for counting the signals provided by the light housing 98, 99 to thereby determine which of the pockets 19 – 25 are filled with sheets 101 and the number of pockets so filled.

Another embodiment of this invention is a deflector means which may be arranged to provide one or more turnstiles 43 and 44 comprised only of the projecting arms 45, and without any deflector rolls 46. Thus, the turnstiles are rotatably supported on the shaft 42 for movement along a generally parallel path adjacent the belt means 35 in the spaces between the belt means as shown in FIG. 1, so that the turnstiles have direct access to the transport plane. It is contemplated that alternatively the turnstiles may contain deflector elements that are of sufficient length to fit between the races of the belts and act against the sheet. In this way, the arms 45 of the turnstiles or the deflector elements on the arms may act directly against the sheet instead of acting against and deforming the belt means into a loop. This general action deflects the sheet from the transport plane into a selected pocket 19 – 25 in response to movement of the shaft 42 on the path. Such embodiment would operate in the environment of the aforedescribed construction taking the place of the carriage deflector means but without the fully extended transverse deflector rolls.

From the foregoing, it will be appreciated that the present invention provides a sheet distributing apparatus which is relatively simple in construction, inexpensive to manufacture and yet provides for positive handling of the sheets at high speed. The turnstile deflector means in association with the endless belt conveyor and the guide rolls afford an effective arrangement for rapidly diverting sheets from the sheet transport plane into selected sheet receiving pockets by locally deforming the endless belt conveyor into a U-shaped loop intermediate adjacent pairs of guide rolls, thereby resulting in positive deflection and guiding of the sheet in its travel from the sheet transport plane into a selected sheet receiving pocket. Additionally, the sheet-turning trough devices provide effective means for deflecting a sheet upwardly and back into the sheet transport plane to permit exiting of the sheet, or transport of the sheet from the apparatus to a similar apparatus arranged in tandem.

What is claimed is:

1. A sheet distributing apparatus, comprising: a plurality of pockets having in-feed openings for receiving sheets in a predetermined sequence; sheet transport means for conveying sheets in feeding relation to the in-feed openings, said sheet transport means comprising guide rolls positioned in spaced apart parallel relation adjacent the in-feed openings and flexible conveyor belt means for capturing the sheets between the conveyor belt means and the guide rolls, whereby the sheets move in a transport plane; and deflector means moveable relative to the conveyor belt means and in timed relation with the sheets, said deflector means including a shaft provided with a plurality of radially extending arms adapted to move between adjacent ones of said guide rolls to form a loop in a conveyor belt means by partially wrapping said conveyor belt means around the guide rolls and the deflector means, thereby changing the direction of the sheet movement from the transport plane to the in-feed opening.

2. A sheet distributing apparatus, comprising: a plurality of pockets for receiving sheets in a predetermined sequence, a frame supporting the pockets in setiatim; flexible endless belt means for transporting sheets in a transport plane adjacent the pockets, means for driving the endless belt means in a sheet feed direction; a pair of guide rolls associated with each of the pockets, said guide rolls positioned in parallel spaced apart relation and extending axially transversely to the transport plane with their peripheries tangent to a lower run of the endless belt means; and deflector means including a shaft extending parallel to said guide rolls and moveable longitudinally of said transport plane, means causing said shaft to rotate about its axis as it moves along said transport plane, said shaft having a plurality of radially extending arms adapted to sequentially move against the lower run of the endless belt means between the successive pairs of said guide rolls, whereby to locally deform the endless belt means into a loop between the guide roll pairs for deflecting a sheet from the transport plane into a pocket.

3. A sheet distributing apparatus as set forth in claim 2 wherein said shaft rotation causing means includes stationary gear rack means extending longitudinally of said transport plane, said shaft having pinion means engaging said rack means causing said shaft rotation during movement thereof along said transport plane.

4. A sheet distributing apparatus, comprising: a plurality of pockets for receiving sheets in a predetermined sequence; a frame supporting the pockets in setiatim; flexible endless belt means for transporting sheets in a transport plane adjacent the pockets; means for driving the endless belt means in a sheet feed direction; a plurality of first guide rolls positioned in parallel spaced apart relation and extending transversely to the transport plane with their peripheries tangent to a lower run of the endless belt means; each of said pockets having a pair of said first guide rolls associated therewith; a plurality of second guide rolls including a pair of guide rolls located adjacent each end of the transport plane and being spaced apart a greater distance than the guide roll pairs associated with said pockets, deflector means movable longitudinally of said transport plane and transversely of said endless belt means between the rolls of each said pair of guide rolls to locally deform the endless belt means into a loop between the guide roll pairs and deflect a sheet from the transport plane, sheet turning means positioned between the rolls of each end guide roll pair and adapted to redirect a sheet back into the transport plane when said deflector means is positioned to deform the endless belt means to form said loop between one of said end guide roll pairs for further transport and exiting of the apparatus.

5. A method of distributing sheets into a plurality of sheet receiving pockets in a predetermined sequence, comprising the steps of: conveying the sheets in a transport plane adjacent in-feed openings of the pockets in a direction of sheet transport; guiding the sheets by conveyor belt means having a lower run thereof in contact engagement with longitudinally spaced guide means aligned with said in-feed openings and capturing the sheets between the conveyor belt means and the guide means whereby the sheets move in a transport plane; and moving deflector means longitudinally of said conveyor belt means and transversely thereof to said longitudinal movement to deflect said conveyor belt means between selected ones of said spaced guide means thereby causing the sheet captured between the conveyor belt means and the guide means to change direction from the transport plane into a pocket.

6. A method as set forth in claim 5 including the step of tensioning the conveyor belt means to maintain it taut in a run of the conveyor belt means extending between the loop and one end of the conveyor belt means.

7. A sheet distributing apparatus, comprising: a plurality of pockets having in-feed openings for receiving sheets in a predetermined sequence; sheet transport means for conveying sheets in feeding relation to said in-feed openings, said sheet transport means comprising guide means positioned in spaced apart parallel relation adjacent said in-feed openings and flexible conveyor means for capturing said sheets between said conveyor means and said guide means whereby said sheets move in a transport plane; deflector means adapted to move relative to said conveyor means and in timed relation with said sheets, said deflector means being adapted to form a loop in said conveyor means by partially wrapping said conveyor means around said guide means and said deflector means, thereby changing the direction of said sheet movement from said transport plane into said in-feed opening; a first control means for arresting movement of the deflector means at the in-feed opening of a pocket, said first control means comprising photo-electric means responsive to markings associated with drive means for moving the deflector means, said markings being indicative of the distance between in-feed openings of said adjacent pockets; a second control means for actuating the deflector means for movement from an arrested position to the in-feed opening of a subsequent pocket, said second control means comprising photo-electric means responsive to deflection of a sheet from a transport plane into the in-feed opening of a pocket.

8. A sheet distributing apparatus, comprising: a plurality of pockets for receiving sheets in a predetermined sequence; a frame supporting the pockets in setiatim; flexible endless belt means for transporting sheets in a transport plane adjacent the pocket; means for driving the endless belt means in a sheet feed direction; a pair of guide rolls associated with each of said pockets; said guide rolls positioned in parallel spaced apart relation and extending axially transversely to the transport plane with their peripheries tangent to a lower run of the endless belt means; deflector means moveable between a raised position above the lower run of the endless belt means and a lowered position acting against the lower run of the endless belt means to locally deform the endless means into a loop between the guide rolls for deflecting a sheet from the transport plane into a pocket, said deflector means including a carriage rotatably supported and moveable along a path parallel to the transport plane, said carriage including a plurality of radially projecting arms arranged at equal radial distances and at equal circumferential distances corresponding to the axial distances between each of the guide roll pairs; and means for driving the carriage along said path.

9. An apparatus as set forth in claim 8 in which the deflector means includes a deflector roll mounted on each of the projecting arms of the carriage for guiding a sheet between one guide roll of a guide roll pair and the loop in the endless belt means.

10. An apparatus as set forth in claim 8 which includes a shaft for supporting the carriage, and the drive means for the carriage includes means for controlling movement of the shaft intermittently or continuously in opposite directions on the path.

11. An apparatus as set forth in claim 10 in which the carriage comprises a pair of turnstiles supported on the shaft, and the drive means includes a pair of drive belts associated with the shaft and operable in opposite directions.

12. An apparatus as set forth in claim 11 in which each of the drive belts is associated with a drive roller and an idler roller, one of the drive rollers being driven by a gear means and a first clutch, and the other drive roller being driven by a belt means and a second clutch, both said clutches being associated with a common drive shaft.

13. An apparatus as set forth in claim 12 in which one of the drive rollers is provided with a brake means associated with a first photoelectric control means for arresting movement of the carriage at selected positions on the path.

14. An apparatus as set forth in claim 12 in which the drive shaft and a second shaft associated with the endless belt means are drivingly connected with a motor, further comprising a variable speed drive means for driving the second shaft and the endless belt means..

15. An apparatus as set forth in claim 14 comprising a tensioning means for maintaining the endless belt means taut in a run of the endless belt means extending between the second shaft and the loop formed by the deflector means.

16. A sheet distributing apparatus comprising: a plurality of pockets having in-feed openings for receiving sheets in a predetermined sequence; sheet transport means for conveying sheets in feeding relation to said in-feed openings, said sheet transport means comprising guide means positioned in spaced apart parallel relation adjacent said in-feed openings and flexible conveyor means for capturing said sheets between said conveyor means and said guide means, whereby said guide sheets move in a transport plane; unitary deflector means operable to deflect said fed sheets into selective ones of said in-feed openings, means moving said deflector means longitudinally relative to said conveyor means and in timed relation with said sheets to position said deflector means between said spaced apart guide means adjacent respective ones of said in-feed openings, means responsive to said longitudinal deflector means movement causing movement of said deflector means transversely of said flexible conveyor means and between said spaced apart guide means, whereby to form a loop in said flexible conveyor means by partially wrapping said flexible conveyor means around said guide means and said deflector means thereby changing the direction of said sheet movement from said transport plane into said in-feed opening.

17. A sheet distributing apparatus as set forth in claim 16 which further includes:

a first control means for arresting movement of the deflector means at the in-feed opening of a pocket; and a second control means for actuating the deflector means for movement from an arrested position to the in-feed opening of a subsequent pocket.

18. A sheet distributing apparatus comprising: a plurality of pockets each having an in-feed opening and receiving sheets in a predetermined sequence; sheet transport means for conveying sheets in feeding relation to said in-feed openings; said sheet transport means comprising guide means positioned in spaced apart relation adjacent said in-feed openings and flexible conveyor means for capturing said sheets between said conveyor means and said guide means, whereby said sheets move in a transport plane; unitary deflector means operable to deflect said fed sheets through selected ones of said in-feed openings and into the associated pockets, means moving said deflector means along said transport plane, and transversely relative to said transport plane in response to movement of said deflector means along said transport plane, to position said deflector means between adjacent ones of said spaced guide means at a selected in-feed opening in timed relation with said sheets for deflecting a sheet through said selected in-feed opening and into the pocket associated therewith.

19. An apparatus as set forth in claim 18 in which the deflector means is adapted to form a loop in said flexible conveyor means by partially wrapping said flexible conveyor means around said guide means and said deflector means, thereby changing the direction of said sheet movement from said transport plane into said in-feed opening.

20. An apparatus as set forth in claim 18 in which the deflector means moves along a generally parallel path adjacent said flexible conveyor means and acts directly against the sheet, thereby changing the direction of said sheet movement from said transport plane into said in-feed opening.

* * * * *

UNITED STATES PATENT AND TRADEMARK OFFICE

CERTIFICATE OF CORRECTION

PATENT NO. : 4,006,894

DATED : February 8, 1977

INVENTOR(S) : Raible et al

It is certified that error appears in the above-identified patent and that said Letters Patent are hereby corrected as shown below:

Column 12, line 3 after "thereof" insert --in response--

Signed and Sealed this

Seventeenth Day of May 1977

[SEAL]

*Attest:*

RUTH C. MASON
*Attesting Officer*

C. MARSHALL DANN
*Commissioner of Patents and Trademarks*